US006661988B2

(12) United States Patent
Ishihara et al.

(10) Patent No.: US 6,661,988 B2
(45) Date of Patent: Dec. 9, 2003

(54) IMAGE-FORMING APPARATUS HAVING A SILICONE ROLLER TO PREVENT FILMING EFFECT

(75) Inventors: Toru Ishihara, Tokyo (JP); Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/151,940

(22) Filed: May 22, 2002

(65) Prior Publication Data

US 2002/0181975 A1 Dec. 5, 2002

(30) Foreign Application Priority Data

May 29, 2001 (JP) ..... 2001-160376

(51) Int. Cl.[7] ..... G03G 15/08
(52) U.S. Cl. ..... 399/279; 399/281; 399/286
(58) Field of Search ..... 399/279, 286, 399/253, 280, 281

(56) References Cited

U.S. PATENT DOCUMENTS 5,001,031 A * 3/1991 Yamamoto et al. ..... 430/109.3
5,443,873 A * 8/1995 Itani et al. ..... 428/36.5
5,750,302 A * 5/1998 Ogawa et al. ..... 430/106.2
5,783,347 A * 7/1998 Ikami ..... 399/279
6,127,081 A * 10/2000 Yamauchi ..... 430/108.3
6,183,926 B1 * 2/2001 Kuroda et al. ..... 399/223
2002/0160292 A1 * 10/2002 Goto et al. ..... 430/110.4

FOREIGN PATENT DOCUMENTS

EP 570010 A1 * 11/1993 ..... G03G/15/02
JP 403145675 A * 6/1991 ..... G03G/15/08
JP 2000120655 A * 4/2000 ..... G03G/15/08

* cited by examiner

*Primary Examiner*—Sophia S. Chen
*Assistant Examiner*—Ryan M. Gleitz
(74) *Attorney, Agent, or Firm*—Rabin & Berdo, PC

(57) ABSTRACT

An image-forming apparatus includes a toner-supplying roller and a developing roller assembled into a developing unit. The toner-supplying roller supplies toner to the developing roller. The developing roller applies the toner to an electrostatic latent image on a photoconductor to form a toner image. The toner image is transferred onto a print medium at a transfer unit, and finally fused into a permanent image at a fixing unit. The toner includes a wax that remains solid at room temperature and melts at a fixing temperature. At least one of the toner-supplying roller and the developing roller is a silicone roller on which oligomer in the form of siloxane is deposited. The silicone roller contains non-cured siloxane in the range of 10 to 8000 PPM.

13 Claims, 2 Drawing Sheets

FIG.2

| AMOUNT OF WAX (WEIGHT PARTS) | 2 | 3 | 4 | 5 | 10 | 20 | 30 | 40 |
|---|---|---|---|---|---|---|---|---|
| NON-OFFSET TEMPERATURE RANGE ℃ | 150-160 | 160-180 | 100-200 | 100-200 | 100-200 | 95-205 | 90-210 | 90-210 |
| TRANSMITTANCE % | 60 | 65 | 70 | 70 | 71 | 72 | 72 | 72 |

FIG.3

(4 WEIGHT PARTS WAX)

| NON-CURED SILOXANE ppm | 5 | 10 | 4000 | 8000 | 10000 | 12000 |
|---|---|---|---|---|---|---|
| FILMING | YES | NO | NO | NO | NO | NO |
| BLURRED IMAGE | NO | NO | NO | NO | LITTLE | YES |

IMAGE-FORMING APPARATUS HAVING A SILICONE ROLLER TO PREVENT FILMING EFFECT

BACKGROUND OF THE INVENTION

1. Field of the Invention

The present invention relates to an electrophotographic image-forming apparatus.

2. Description of the Related Art

A conventional electrophotographic image-forming apparatus performs a printing operation consisting of five electrophotographic processes: charging, exposing, developing, transferring, and fixing. A charging unit charges the surface of a photoconductor uniformly. An exposing unit in the form of an LED head or a laser head illuminates the charged surface of the photoconductor to form an electrostatic latent image. A developing unit applies triboelectrically charged toner to the electrostatic latent image by the Coulomb force, thereby developing the electrostatic latent image into a toner image. A transferring unit transfers the toner image onto a print medium that passes between the photoconductor and a transfer roller. Then, the print medium passes through a fixing unit where the toner image on the print medium is fused into a permanent image.

With the aforementioned conventional apparatus, oil is supplied to the surface of rollers of the fixing unit to prevent so-called "hot-offset" where the toner on the print medium is deposited on the rollers of the fixing unit. For an oil-free type fixing unit, toner contains a considerable amount of wax.

Especially for printing a color image on an OHP, the toner is required of heat fusibility having a very low viscosity. Therefore, oil needs to be supplied to the rollers of the fixing unit or wax needs to be added to the toner.

However, the wax contained in the toner is solid at room temperature. Wax is effective in preventing a problem of offset but has a disadvantage of a so-called "filming" where the wax deposited on toner-carrying members such as a developing roller and a developing blade serves as a paste to form a film of toner. The wax deposited on the toner-carrying members is an obstacle to forming uniform thickness of toner layer on the toner-carrying members. Further, toner deposited on the edge of the developing blade forms tiny projections that scratch the toner layer formed on the developing roller, preventing the toner from being deposited uniformly on the developing roller. "Filming" causes deterioration of print quality.

SUMMARY OF THE INVENTION

An object of the present invention is to provide an image-forming apparatus capable of preventing "filming" where wax is deposited on toner-carrying members such as a developing roller and a developing blade serves as a paste to form a film of toner.

An image-forming apparatus includes a developing unit and a fixing unit. The developing unit includes a developing roller and a toner-supplying roller that supplies toner to the developing roller. The developing roller applies the toner to an electrostatic latent image on a photoconductor to form a toner image. The toner image is transferred onto a print medium, and finally fused into a permanent image. The toner includes a wax that remains solid at room temperature and melts at a fixing temperature. At least one of the toner-supplying roller and the developing roller is a silicone roller on which oligomer in the form of siloxane is deposited.

The silicone roller contains non-cured siloxane in the range of 10 to 8000 PPM.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 2 shows the test results of a toner according to the present invention; and FIG. 3 illustrates test results when printing is performed using the toner and a silicon roller according to the present invention.

DETAILED DESCRIPTION OF THE INVENTION

First Embodiment

{Construction}

Figure 1:
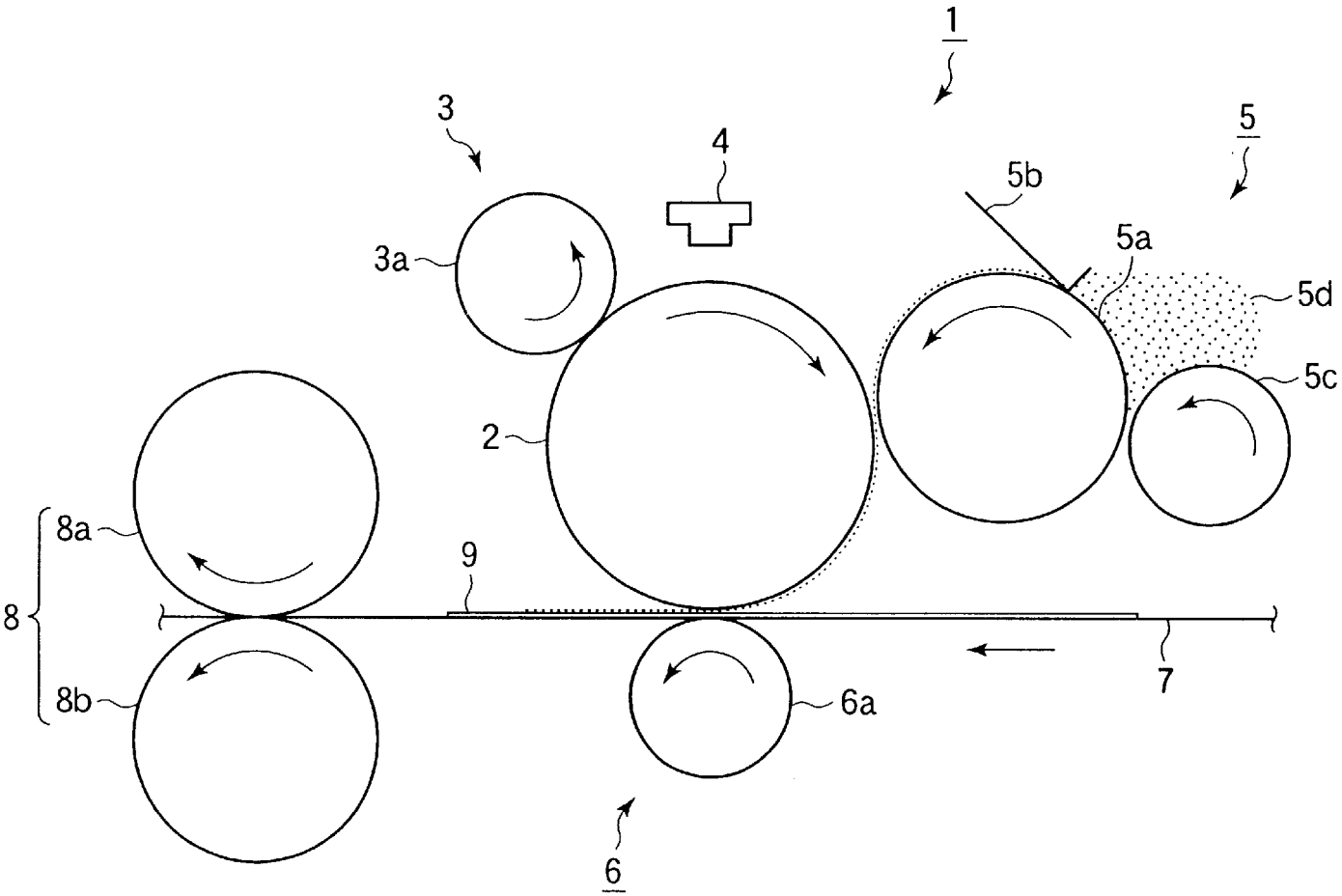
FIG. 1 illustrates a general construction of an image-forming apparatus according to the present invention.

FIG. 1 illustrates a general construction of an image-forming apparatus according to the present invention. The image-forming apparatus 1 includes a charging unit 3, an exposing unit 4, a developing unit 5, and a transfer unit 6, which are disposed around a photoconductive drum 2. There is provided a fixing unit 8 in a transport path 7 of a print medium downstream of a transfer point defined between the photoconductive drum 2 and the transfer unit 6.

The charging unit 3 applies a negative high-voltage to a charging roller 3*a* that rotates in contact with the photoconductive drum 2, thereby charging the surface of the photoconductive drum 2. The exposing unit 4 selectively energizes light-emitting elements in accordance with print data, thereby selectively illuminating areas on the charged surface of the photoconductive drum 2 to form an electrostatic latent image.

The developing unit 5 includes a developing roller 5*a*, a developing blade 5*b*, and a toner-supplying roller 5*c*, and accommodates toner 5*d* as a developer material therein. The developing roller 5*a* and developing blade 5*b* receive negative high-voltages, more negative than that of the surface of the photoconductive drum 2, so that the toner is charged negatively and formed into a thin layer.

For a contact type developing roller where the developing roller 5*a* is in contact with the photoconductive drum 2, the developing roller 5*a* is in the shape of a rubber roller having a smooth roller surface. For a non-contact type developing roller, e.g., magnetic developing technique, the developing roller is not required to have a rubber surface. The toner-supplying roller 5*c* is in the form of a sponge roller.

The transfer unit 6 applies a positive high-voltage to a transfer roller 6*a* to positively charge a print medium 9 that is transported between the photoconductor 2 and the transfer unit 6 along the transport path 7.

The fixing unit 8 includes a heating roller 8*a* and a pressure roller 8*b*, and heats the toner 5*d* on the print medium 9 when the print medium 9 passes a point where the heat roller 8*a* and the pressure roller 8*b* are in pressure contact with each other.

A controller, not shown, controls a drive motor, not shown, to drive the photoconductive drum 2, the charging roller 3*a*, the developing roller 5*a*, the toner-supplying roller 5*c*, the heating roller 8*a*, and the pressure roller 8*b* in rotation in directions shown by arrows.

{Operation}

When the controller receives a print command from a host apparatus, not shown, the controller causes the photoconductive drum 2, the charging roller 3*a*, the developing roller 5*a*, the toner-supplying roller 5*c*, the heating roller 8*a*, and the pressure roller 8*b* to rotate in the directions shown by arrows.

Then, the controller causes the charging unit 3 to apply the negative high-voltage to the charging roller 3*a*, thereby uniformly charging the surface of the photoconductive drum 2 negatively. Then, the controller causes the exposing unit 4 to selectively energize the light-emitting elements in accordance with the print data to form an electrostatic latent image on the photoconductive drum 2.

Then, the controller causes the developing unit 5 to apply negative high voltages to the developing roller 5*a* and toner-supplying roller 5*c*, thereby negatively charging the toner 5*d* so that the toner 5*d* is deposited to the electrostatic latent image by the Coulomb force. Thus, the electrostatic latent image is developed into a toner image.

Then, the controller causes the transfer unit 6 to apply a high voltage to the transfer roller 6*a*, thereby charging the print medium 9 passing through a transfer point to be charged positively, so that the toner image is transferred from the photoconductive drum 2 to the print medium 9.

{Toner}

The toner 5*d* of the invention will be described in detail with reference to FIG. 2.

The toner 5*d* according to the present invention contains a lubricant (referred to as wax hereinafter) that is solid at room temperature and melts at a fixing temperature.

The toner 5*d* contains 100 weight parts polyester resin (number average molecular weight Mn=3700, glass transition point Tg=62° C.), 4.5 weight parts phthalocyanine blue, 2.5 weight parts charge control agent, and an amount of carnauba wax.

The mixture is agitated in a Henschel mixer, then heated at 120° C. in a roll mill for about 30 minutes, finally the mixture is cooled down to room temperature. The thus kneaded material is ground, and then air-classified into toner particles having an average diameter of 8 $\mu$m.

FIG. 2 shows the test results of the aforementioned toner 5*d*, illustrating the relationship among the amount of carnauba wax, the temperature range in which no offset occurs, and the transmittance of light. The toner 5*d* was evaluated for different amounts of carnauba wax. The melting point is about 80° C.

The silicone roller according to the invention will be described in detail with reference to FIG. 3. At least one of the developing roller 5*a* and the toner-supplying roller 5*c* takes the form of a silicone roller that contains oligomer in the form of siloxan. The silicone roller is manufactured as follows: The following materials are mixed: 100 parts methyl vinyl poly siloxan having an average degree of polymerization of about 8000 and consisting of 99.85 mol % dimethyl siloxan unit, 0.15 mol % methyl vinyl siloxan unit; 20 parts treated silica R-972 (from Aerosil Japan); 130 parts spherical elastomer particles (silicone powder) KMP594 (particle diameter is 3 to 10 $\mu$m, from Shinetsu Kagaku Kogyo). Then, 13 parts acetylene black is added and the material is kneaded. Then, 1.6 parts organic peroxide 2.5-dimethyl-2.5 (t-Butyl peroxide) hexane is added to the material and then the material is kneaded again. The thus obtained compound is molded with predetermined molding (i.e., primary vulcanization) conditions (e.g., 170° C., 15 minutes, and 30 kg-cm$^2$). Then, the material is vulcanized with secondary vulcanization conditions (200° C., 2 hours). Thereafter, the material is polished to a predetermined diameter using a cylindrical polishing machine.

The developing roller 5*a* in the form of the aforementioned silicone roller was assembled into the developing unit 5, and the developing unit 5 was filled with the aforementioned toner 5*d* of the invention. When printing was performed on paper (XEROX 4200) at a printing duty of 100%, a visual inspection detected no offset in the temperature range of 100–200° C. When printing was performed on OHP (OHP CG3300 from 3M), the transmittance was 70%. The image printed on the OHP was projected with a projector and the projected image was very vivid.

The fixing unit 8 performs a fixing operation at a temperature in the range of 140 to 160° C. to fuse the toner 5*d*. The carnauba wax melts at about 80° C., lower than the fixing temperature, so that the carnauba wax becomes a liquid that serves as an oil to prevent hot-offset.

A total of 30,000 pages were printed continuously and a high quality print was obtained for all of the pages. No filming was observed on the developing roller 5*a* and developing blade 5*b* (FIG. 3). This is because the oligomer such as non-cured siloxane deposited on the silicone roller prevents wax, solidified at room temperature, from being deposited on the developing roller 5*a* and/or developing blade 5*b*.

Increasing the amount of wax widens a non-offset temperature range to 90–210° C. and increases the transmittance of light to 72%.

FIG. 3 illustrates test results when printing was performed for different amounts of non-cured siloxane contained in the silicone roller. The printing was performed using the toner 5*d* that contains 4 weight parts carnauba wax.

When the amount of non-cured siloxane in the silicone roller was in the range of 10 to 8000 PPM, the print result was not blurred, and no filming occurred. When the amount of non-cured siloxane was 5 PPM, no print result was blurred but filming occurred.

When the amount of non-cured siloxane was 10,000 PPM, no filming occurred but the print result was somewhat blurred.

Therefore, in the present invention, the amount of non-cured siloxane contained in the silicone roller is selected in the range of 10 to 8000 PPM.

The developer material of the present invention is a toner that contains a wax that remains solid at room temperature and melts at a fixing temperature. At least one of the developing roller and toner-supplying roller of the developing unit takes the form of a silicone roller on which oligomer in the form of siloxane is deposited. Thus, during the fixing operation, the wax melts to prevent "hot-offset" to the fixing unit. During the developing operation, lubrication effect of the oligomer in the form of siloxane deposited on the silicone roller prevents filming on the developing roller and developing blade. Thus, print quality is improved.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image-forming apparatus comprising a toner-supplying roller, a developing roller, a photoconductor and a developing blade that is in contact with the developing roller to form a toner layer on the developing roller, wherein the toner-supplying roller supplies toner to the developing roller, and the developing roller applies the toner to an electrostatic latent image on the photoconductor to form a toner image, thereby the toner image is transferred onto a print medium and finally fused into a permanent image, wherein the toner includes a lubricant that remains solid at room temperature and melts at a fixing temperature, and wherein at least one of the toner-supplying roller and the developing roller is a silicone roller that contains non-cured siloxane that must fall in the range of 10 to 8,000 PPM, so that siloxane on a surface of the silicone roller prevents filming of the lubricant on the developing blade.

2. The image-forming apparatus according to claim 1, further comprising an oil-free fixing unit to fuse the toner image on the print medium into the permanent image.

3. The image-forming apparatus according to claim 2, wherein a fixing temperature of the fixing unit is in the range of 100 to 200° C.

4. The image-forming apparatus according to claim 2, wherein the fixing unit includes a heating roller and a pressure roller.

5. The image-forming apparatus according to claim 2, further comprising a contact-type developing unit that includes the toner-supplying roller and the developing roller.

6. The image-forming apparatus according to claim 2, wherein the lubricant is wax.

7. The image-forming apparatus according to claim 6, wherein the wax is carnauba wax having a melting point of about 80° C.

8. The image-forming apparatus according to claim 1, wherein the toner is polyester resin having a number average molecular weight of substantially 3700 and a glass transition point of substantially 62° C.

9. The image-forming apparatus according to claim 1, wherein the toner includes the lubricant by 4 weight parts and a polyester resin by 100 weight parts.

10. The image-forming apparatus according to claim 1, wherein the toner has an average diameter of substantially 8 $\mu$m.

11. The image-forming apparatus according to claim 1, wherein the silicone roller is vulcanized twice.

12. The image-forming apparatus according to claim 1, wherein the siloxane contained in the silicone roller is determined by Inductively Coupled Plasma (ICP) spectrometry in terms of an amount of silicone.

13. The image-forming apparatus according to claim 1, wherein the toner has a transmittance of substantially 70% when printing is performed on an OHP transparency.

* * * * *